US008740373B2

(12) United States Patent
Kobayashi

(10) Patent No.: US 8,740,373 B2
(45) Date of Patent: Jun. 3, 2014

(54) IMAGE FORMING METHOD AND IMAGE FORMING DEVICE

(75) Inventor: Masaru Kobayashi, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 180 days.

(21) Appl. No.: 13/366,407

(22) Filed: Feb. 6, 2012

(65) Prior Publication Data

US 2012/0229581 A1 Sep. 13, 2012

(30) Foreign Application Priority Data

Mar. 8, 2011 (JP) ..... 2011-050261

(51) Int. Cl.
*B41J 2/01* (2006.01)

(52) U.S. Cl.
USPC ..... 347/102

(58) Field of Classification Search
USPC ..... 347/88, 95–103, 104
See application file for complete search history.

(56) References Cited

U.S. PATENT DOCUMENTS

2009/0311426 A1* 12/2009 Nakazawa et al. ..... 427/256
2009/0315926 A1* 12/2009 Yamanobe ..... 347/6
2010/0231673 A1* 9/2010 Chiwata ..... 347/102
2011/0058001 A1* 3/2011 Gila et al. ..... 347/103

FOREIGN PATENT DOCUMENTS

JP 9-011654 A 1/1997
JP 4010577 B2 11/2007

* cited by examiner

*Primary Examiner* — Julian Huffman
*Assistant Examiner* — Sharon A Polk
(74) *Attorney, Agent, or Firm* — SOLARIS Intellectual Property Group, PLLC

(57) ABSTRACT

An image forming method includes an ejecting step, a drying step after the ejecting step, and a particle-providing step after the drying step. The ejecting step includes ejecting aqueous ink onto a recording medium and forming an image. The drying step includes drying such that a difference between a water amount contained in the recording medium after the drying and a water amount that was contained in the recording medium before the ejecting is from 1.0 g/m$^2$ to 4.0 g/m$^2$. The particle-providing step includes supplying particles to the surface of a roller and, via the roller, providing the particles to a face of the recording medium at which the image has been formed.

6 Claims, 9 Drawing Sheets

IMAGE FORMING METHOD AND IMAGE FORMING DEVICE

CROSS-REFERENCE TO RELATED APPLICATION

This application claims priority under 35 USC 119 from Japanese Patent Application No. 2011-050261 filed on Mar. 8, 2011, the disclosure of which is incorporated by reference herein.

BACKGROUND

1. Technical Field

The present invention relates to an image forming method and an image forming device.

2. Related Art

Heretofore, an image forming device that ejects ink droplets from an inkjet recording head onto a recording medium such as paper or the like has been known.

In this image forming device, ink droplets are ejected onto the recording medium, the ink droplets on the recording medium are dried by heating and fixed, and then the recording mediums are successively discharged to and stacked on a discharge section. In this image forming device, when the recording mediums are stacked on the discharge section, a phenomenon known as blocking (hereinafter referred to as stacker blocking) may occur, in which ink adheres between the recording mediums laid on top of one another. In particular, in a high-productivity inkjet recording device, insufficient drying or insufficient fixing of the ink often occurs, so stacker blocking often occurs.

Japanese Patent Application Laid-Open (JP-A) No. 9-011654 discloses a powder coating method, of coating powder onto the ink on printed matter just after printing and before drying. In this method, the powder is supplied to an outer periphery face of a rotating roller, the powder is attracted to and retained at the outer periphery face of the rotating roller, the printed matter that has just been printed is fed to the rotating roller at which the powder is being attracted and retained, and the powder is transferred, because of the viscosity of the ink, onto a printed image face of the printed matter.

Japanese Patent No. 4,010,577 discloses a structure in which a matting agent is retained in numerous depressions formed with a predetermined spacing in the surface of a coating roller, and the matting agent is coated onto printed matter in the form of spots with the predetermined spacing.

However, in JP-A No. 9-011654, the rotating roller rubs off powder that has been momentarily transferred to the printed matter. Therefore, a transfer efficiency of the powder is low and satisfactory performance may not be provided.

In Japanese Patent No. 4,010,577, the ink tends to gradually accumulate in the depressions of the coating roller, and it is difficult to maintain excellent coating performance (i.e., transferring performance for required matting agent provision amounts).

SUMMARY

In light of the situation described above, the present invention provides an image forming method and image forming device that may efficiently and reliably adhere particles to an image formation face of a recording medium, and suppress occurrences of stacker blocking.

An image forming method of a first aspect of the present invention includes: ejecting aqueous ink onto a recording medium and forming an image; after the ejecting, drying such that a difference between a water amount contained in the recording medium after the drying and a water amount contained in the recording medium before the ejecting is from 1.0 $g/m^2$ to 4.0 $g/m^2$; and after the drying, particle-providing including supplying particles to a surface of a roller and, via the roller, providing the particles to a face of the recording medium at which the image has been formed.

According to the invention described above, the ink is ejected onto the recording medium and an image is formed by the ejecting. After the ejecting, the drying is performed such that the difference between the water amount contained in the recording medium after the drying and the initially contained water amount before the ejecting is from 1.0 $g/m^2$ to 4.0 $g/m^2$. Then, after the drying, the particles are supplied to the roller surface and, via the roller, the particles are provided to the face of the recording medium at which the image has been formed, by the particle-providing. Thus, because the difference between the water amount contained in the recording medium after the drying and the initially contained water amount before the ejecting is made large, the surface ink layer on the recording medium remains in a soft condition and a larger number of particles may be efficiently and reliably adhered to the face of the recording medium on which the image has been formed.

An image forming method of a second aspect of the present invention is the first aspect of the invention in which the ink includes resin particles and an aqueous solvent, and, after the drying, a relationship between a temperature $T_s$ of a surface ink layer to which the ink has been ejected onto the recording medium and a minimum film formation temperature MFT of the resin particles in the ink satisfies the condition $T_s$<MFT.

According to the invention described above, because the drying is carried out with a temperature lower than the minimum film formation temperature MFT such that the relationship between the temperature $T_s$ of the surface ink layer and the minimum film formation temperature MFT of the resin particles is $T_s$<MFT, film formation of the ink is not complete after the drying, and a larger number of particles may be adhered under conditions that are excellent for close adhesion of the particles to image portions of the recording medium.

An image forming method of a third aspect of the present invention is the second aspect of the invention in which the roller is a heating and pressing roller that fixes the image formed on the recording medium, the particle-providing includes supplying the particles to the surface of the heating and pressing roller, and pressing the heating and pressing roller against the recording medium, and a relationship between the minimum film formation temperature MFT and a temperature $T_r$ of the heating and pressing roller satisfies the condition $T_r$<MFT.

According to the invention described above, the particle-providing includes supplying the particles to the surface of the heating and pressing roller and pressing the heating and pressing roller against the recording medium. At this time, because the image portions of the recording medium are fixed by heat and pressure from the heating and pressing roller at a temperature lower than the minimum film formation temperature MFT, film formation of the ink is not complete, and a larger number of particles may be adhered under conditions that are excellent for close adhesion of the particles to the image portions of the recording medium.

An image forming method of a fourth aspect of the present invention is the first aspect of the invention in which a relationship between a mass per unit area $M_1$ of an aqueous solvent contained in a surface ink layer just after the ink is ejected onto the recording medium in the ejecting and a mass per unit area $M_2$ of the aqueous solvent contained in the surface ink layer after the drying satisfies the condition $0.25<M_2/M_1<0.50$.

According to the invention described above, because the amount of the aqueous solvent contained in the surface ink layer of the recording medium after the drying is large, the surface ink layer on the recording medium remains in a soft condition and a larger number of particles may be easily adhered.

An image forming device of a fifth aspect of the present invention includes: an imaging section that ejects aqueous ink onto a recording medium and forms an image; a drying section that dries the recording medium at which the image has been formed by the imaging section such that a difference between a water amount contained in the recording medium after the drying and a water amount contained in the recording medium before the ejecting is from 1.0 g/m$^2$ to 4.0 g/m$^2$; and a particle provision section that supplies particles to a surface of a roller and, via the roller, provides the particles to a face of the recording medium dried by the drying section at which face the image has been formed.

According to the invention described above, the imaging section ejects the ink onto the recording medium and forms an image. The drying section dries the recording medium such that the difference between the water amount contained in the recording medium after the drying and the initially contained water amount before the ejecting is from 1.0 g/m$^2$ to 4.0 g/m$^2$. Then, the particle provision section supplies the particles to the roller surface and, via the roller, provides the particles to the face of the recording medium at which the image has been formed. Thus, because the difference between the water amount contained in the recording medium that has been dried by the drying section and the initially contained water amount before the ejecting is made large, the surface ink layer on the recording medium remains in a soft condition and a larger number of particles may be efficiently and reliably adhered to the face of the recording medium on which the image has been formed.

An image forming device of a sixth aspect of the present invention is the fifth aspect of the invention in which the ink includes resin particles and an aqueous solvent, and a relationship between a temperature $T_s$ of a surface ink layer to which the ink has been ejected onto the recording medium dried by the drying section and a minimum film formation temperature MFT of the resin particles in the ink satisfies the condition $T_s<MFT$.

According to the invention described above, because the drying section carries out drying with a temperature lower than the minimum film formation temperature MFT such that the relationship between the temperature $T_s$ of the surface ink layer and the minimum film formation temperature MFT of the resin particles is $T_s<MFT$, film formation of the ink is not complete, and a larger number of particles may be adhered under conditions that are excellent for close adhesion of the particles to the image portions of the recording medium.

An image forming device of a seventh aspect of the present invention is the sixth aspect of the invention in which the roller is a heating and pressing roller that fixes the image formed on the recording medium, the particle provision section supplies the particles to the surface of the heating and pressing roller, and presses the heating and pressing roller against the recording medium, and a relationship between the minimum film formation temperature MFT and a temperature $T_r$ of the heating and pressing roller satisfies the condition $T_r<MFT$.

According to the invention described above, the particle provision section supplies the particles to the surface of the heating and pressing roller, and presses the heating and pressing roller against the recording medium. At this time, because the image portions of the recording medium are fixed by heat and pressure from the heating and pressing roller at a temperature lower than the minimum film formation temperature MFT, film formation of the ink is not complete, and a larger number of particles may be adhered under conditions that are excellent for close adhesion of the particles to the image portions of the recording medium.

An image forming device of an eighth aspect of the present invention is the fifth aspect of the invention in which a relationship between a mass per unit area $M_1$ of an aqueous solvent contained in a surface ink layer just after the ink is ejected onto the recording medium at the imaging section and a mass per unit area $M_2$ of the aqueous solvent contained in the surface ink layer of the recording medium dried by the drying section satisfies the condition $0.25<M_2/M_1<0.50$.

According to the invention described above, because the amount of the aqueous solvent contained in the surface ink layer of the dried recording medium is large, the surface ink layer on the recording medium remains in a soft condition and a larger number of particles may be easily adhered.

BRIEF DESCRIPTION OF THE DRAWINGS

Exemplary embodiments of the present invention will be described in detail based on the following figures, wherein.

DETAILED DESCRIPTION

Herebelow, an example of an embodiment relating to the present invention is described with reference to the attached drawings.

—Overall Structure—

Figure 1:
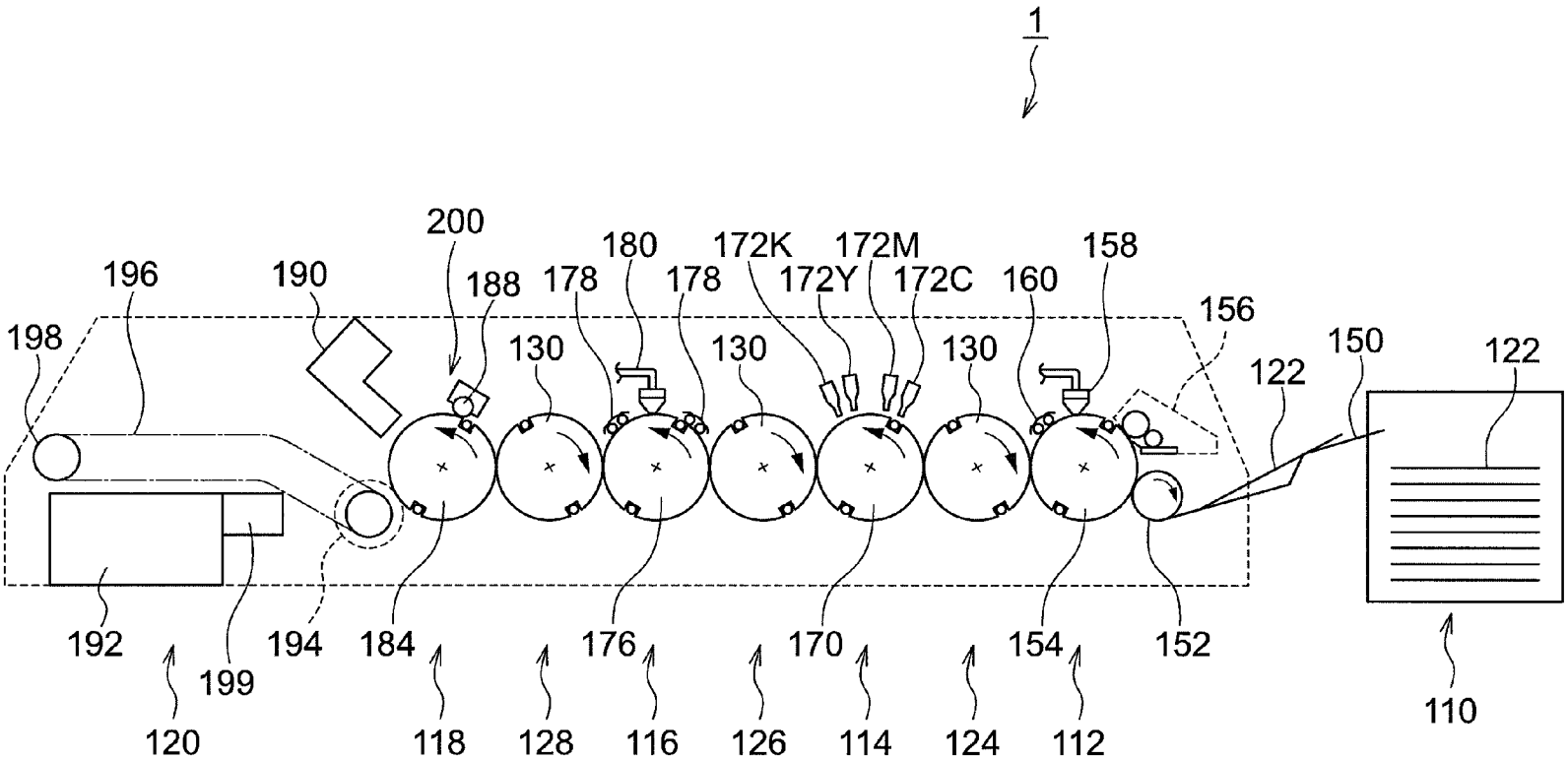
FIG. 1 is a schematic diagram illustrating overall structure of an image forming device in which an image forming method relating to a first exemplary embodiment of the present invention is employed.

Below, a structural example of an inkjet-type image forming device for embodying a first exemplary embodiment of the image forming method of the present invention is described with reference to FIG. 1. FIG. 1 is a schematic diagram (side view) illustrating the whole of the image forming device.

An inkjet recording device 1 is an impression cylinder direct imaging-type inkjet recording device that ejects ink (droplets) of plural colors from inkjet heads 172C, 172M, 172Y and 172K, which serve as an example of a droplet ejection apparatus, and forms a desired color image on a paper 122 that is retained on an impression cylinder (an imaging drum 170) of an imaging section 114. The inkjet recording device 1 is an on-demand type image forming device employing a two-liquid reaction (coagulation) system in which a processing liquid (an ink coagulation processing liquid) is applied to the paper 122 serving as a recording medium before the ejection of the inks and the processing liquid reacts with the inks to form an image on the paper 122.

The inkjet recording device 1 is principally constituted with a paper supply section 110, a processing liquid application section 112, the imaging section 114, a drying section 116, a fixing section 118 and a discharge section 120.

The paper supply section 110 is a mechanism that supplies the paper 122 to the processing liquid application section 112. The paper 122, which is sheets of paper, is stacked in the paper supply section 110. A paper supply tray 150 is provided in the paper supply section 110, and the paper 122 is supplied from the paper supply tray 150 to the processing liquid application section 112 one sheet at a time. In the inkjet recording device 1, plural kinds of the paper 122 may be used, of different paper types, sizes (media sizes) and the like. In the present exemplary embodiment, the use of sheets of paper (cut paper) is described as the paper 122.

The processing liquid application section 112 is a mechanism that applies the processing liquid to a recording face (an image formation face) of the paper 122. The processing liquid includes a colorant coagulant that causes colorants in the inks applied by the imaging section 114 to coagulate. Separation of each ink into a colorant and a solvent is promoted by the processing liquid and the ink coming into contact.

As illustrated in FIG. 1, the processing liquid application section 112 is provided with a paper supply cylinder 152, a processing liquid drum 154 and a processing liquid application apparatus 156. The processing liquid drum 154 is a drum that retains the paper 122 and turns to convey the paper 122. The processing liquid drum 154 is provided with a pawl-form retainer (a gripper) at an outer periphery face thereof. A leading end of the paper 122 may be retained by the paper 122 being nipped between the pawl of the retainer and the periphery face of the processing liquid drum 154.

The processing liquid drum 154 may be provided with suction holes in the outer periphery face thereof and connected to a suction unit that applies suction through the suction holes. Thus, the paper 122 may be retained in area contact with the periphery face of the processing liquid drum 154.

The processing liquid application apparatus 156 is disposed at the outer side of the processing liquid drum 154, opposing the periphery face of the processing liquid drum 154. The processing liquid application apparatus 156 is structured by a processing liquid container in which the processing liquid is stored, an anilox roller of which a portion is immersed in the processing liquid in the processing liquid container, and a rubber roller that presses against the anilox roller and the paper 122 on the processing liquid drum 154 and transfers metered amounts of the processing liquid to the paper 122. According to this processing liquid application apparatus 156, the processing liquid may be metered while being applied to the paper 122. At a downstream side of the paper 122 conveyance direction relative to the processing liquid application apparatus 156, a hot air heater 158 and an infrared heater 160 are provided, which dry the processing liquid applied to the paper 122.

The paper 122 to which the processing liquid has been applied by the processing liquid application section 112 is handed over from the processing liquid drum 154 to the imaging drum 170 of the imaging section 114 via an intermediate conveyance section 124 (a handover cylinder 130). The imaging section 114 is provided with the imaging drum 170 and the inkjet heads 172C, 172M, 172Y and 172K. Similarly to the processing liquid drum 154, the imaging drum 170 is provided with a pawl-form retainer (gripper) at the outer periphery face thereof. The paper 122 that is fixed to the imaging drum 170 is conveyed with the recording face thereof facing outward, and the inks are applied to the recording face from the inkjet heads 172C, 172M, 172Y and 172K (ejecting step). Aqueous inks including aqueous solvent are used as the inks.

Each of the inkjet heads 172C, 172M, 172Y and 172K is a full-line inkjet-type recording head (inkjet head) with a length corresponding to the maximum width of an image forming region of the paper 122. Nozzle rows, in which plural nozzles for ink ejection are arrayed over the whole width of the ink ejection region, are formed in an ink ejection face of each of the inkjet heads 172C, 172M, 172Y and 172K. The inkjet heads 172C, 172M, 172Y and 172K are each arranged so as to extend in a direction orthogonal to the conveyance direction of the paper 122 (the rotation direction of the imaging drum 170).

Droplets of the inks of corresponding colors are ejected from the inkjet heads 172C, 172M, 172Y and 172K towards the recording face of the paper 122 that is retained in area contact with the imaging drum 170. Hence, the inks come into contact with the processing liquid previously applied to the recording face by the processing liquid application section 112, colorant and resin particles dispersed in the ink coagulate, and coagulations are formed. Thus, colorant flow or the like on the paper 122 is prevented, and an image is formed on the recording face of the paper 122.

The paper 122 on which the image has been formed by the imaging section 114 is handed over from the imaging drum 170 to a drying drum 176 of the drying section 116 via an intermediate conveyance section 126 (a first drying step). The drying section 116 is a mechanism that dries out water contained in the solvent that has been separated by the coagulation action. As illustrated in FIG. 1, the drying drum 176 is provided with a plural number of infrared heaters 178 and a hot air heater 180 that is disposed between the infrared heaters 178.

Similarly to the processing liquid drum 154, the drying drum 176 is provided with a pawl-type retainer (gripper) at the outer periphery face thereof, and may retain the leading end of the paper 122 with this retainer. A temperature and wind amount of a hot wind blown from the hot air heater 180 toward the paper 122 and temperatures of the infrared heaters are detected by temperature sensors and sent to an unillustrated control section as temperature data. The control section suitably adjusts the temperature and wind amount of the hot wind and the temperatures of the infrared heaters in accordance with the temperature data. Thus, a variety of drying conditions can be realized.

A surface temperature of the drying drum 176 may be set to 50° C. or more. Thus, drying is promoted by heating from the rear face of the paper 122 and damage to the image during fixing may be prevented. An upper limit of the surface temperature of the drying drum 176 is not particularly limited but is preferably set to 75° C. or less with a view to safety in maintenance operations such as cleaning off ink that has adhered to the surface of the drying drum 176 (i.e., avoiding burn injuries that are caused by high temperatures).

The paper 122 is retained at the outer periphery face of the drying drum 176 such that the recording face faces outward (that is, in a state of being curved such that the recording face of the paper 122 is at the convex side), and the drying drum 176 dries the recording face of the paper 122 while turning for conveyance. Thus, the formation of wrinkles, lifting or the like on the paper 122 may be prevented, and unevenness in drying that results therefrom may be prevented.

The paper 122 that has been subjected to drying processing by the drying section 116 is handed over from the drying drum 176 to a fixing drum 184 of the fixing section 118 via an intermediate conveyance section 128. A hot air heater (not illustrated) that blows a hot wind at the recording face of the paper 122 may be provided in a handover cylinder 130 of the intermediate conveyance section 128 (a second drying step). When a hot air heater is provided in the handover cylinder 130 of the intermediate conveyance section 128, the water contained in the solvent that has been separated by the coagulation action may be dried just after the inks have been ejected onto the paper 122 by the inkjet heads 172C, 172M, 172Y and 172K. Drying conditions at the drying section 116 and the handover cylinder 130 of the intermediate conveyance section 128 are described below.

The fixing section 118 is structured by the fixing drum 184, which retains and conveys the paper 122, a fixing roller (a heating and pressing roller) 188 that serves as an example of a roller, and an inline sensor 190.

Similarly to the processing liquid drum 154, the fixing drum 184 is provided with a pawl-type retainer (gripper) at the outer periphery face thereof, and may retain the leading end of the paper 122 with this retainer. The paper 122 is conveyed with the recording face facing outward by rotation of the fixing drum 184, fixing processing is carried out on the recording face by the fixing roller 188, and the recording face is checked by the inline sensor 190.

The fixing roller 188 is a roller member for fusing resin particles in the ink (particularly self-dispersing polymer particles) and forming the ink into a skin by heating and pressing the ink, and is constituted so as to heat and press the paper 122.

Specifically, the fixing roller 188 is disposed so as to be pressed against the fixing drum 184 by unillustrated springs, and constitutes a nipping roller against the fixing drum 184. The fixing roller 188 is constituted to rotate passively with rotation of the fixing drum 184 at which the paper 122 is retained. Thus, the paper 122 is nipped between the fixing roller 188 and the fixing drum 184, being nipped with a predetermined nipping pressure (for example, 0.15 MPa), and is subjected to fixing processing.

The fixing roller 188 is constituted by a heating roller in which a halogen lamp is contained in a metal pipe with good thermal conductivity, of aluminum or the like, and is controlled to a predetermined temperature (for example, 60-80° C.).

Heat energy to at least the glass transition temperature (Tg) of the resin particles contained in the ink is applied by the paper 122 being heated by the heating roller. Thus, by the resin particles being fused, the resin particles are pressed into roughnesses in the paper 122 and fixing is implemented. In addition, roughnesses in the image surface are levelled and glossiness is provided.

A particle provision apparatus 200 is disposed at a position opposing the fixing drum 184. The particle provision apparatus 200 provides matting agent particles, which serve as an example of particles. The particle provision apparatus 200 is provided with the fixing roller 188 and a supply unit 202. The fixing roller 188 serves as an example of a roller that touches against the recording face (image formation face) of the paper 122 being retained and conveyed on the fixing drum 184. The supply unit 202 is disposed at the fixing roller 188 rotation direction upstream side relative to the position at which the fixing roller 188 touches the paper 122, and supplies the matting agent particles to the fixing roller 188. In the particle provision apparatus 200, the matting agent particles from the supply unit 202 are supplied to the surface of the fixing roller 188, the fixing roller 188 turns, and the matting agent particles are provided to the recording face of the paper 122 (a particle-providing step). The particle provision apparatus 200 is described below.

The inline sensor 190 is a measurement unit for measuring a check pattern, water amount, surface temperature, glossiness and the like of the image fixed to the paper 122. A CCD line sensor or the like is employed as the inline sensor 190.

According to the fixing section 118, the resin particles in the thin image layer formed by the drying section 116 may be fixed to the paper 122 by being pressed and heated by the fixing roller 188 and fused. Moreover, because the surface temperature of the fixing drum 184 is set to at least 50° C. and the paper 122 retained at the outer periphery face of the fixing drum 184 is heated from the rear face thereof, drying is promoted, damage to the image during fixing may be avoided, and image strength may be increased by an effect of raising the image temperature.

As illustrated in FIG. 1, the discharge section 120 is provided at the recording medium conveyance direction downstream side of the fixing section 118. The discharge section 120 is provided with a discharge tray 192. A handover cylinder 194, a conveyance belt 196 and a tension roller 198 are provided between the discharge tray 192 and the fixing drum 184 of the fixing section 118 so as to communicate therebetween. The paper 122 is transported to the conveyance belt 196 by the handover cylinder 194 and discharged to the discharge tray 192.

Although not illustrated in FIG. 1, in addition to the structures described above, the inkjet recording device 1 is provided with storage tanks that supply the inks to the respective inkjet heads 172C, 172M, 172Y and 172K and with means for supplying the processing fluid to the processing liquid application section 112. The inkjet recording device 1 is also provided with a head maintenance section that cleans the inkjet heads 172C, 172M, 172Y and 172K (wiping nozzle faces, purging, sucking out nozzles and the like), position detection sensors that sense positions of the paper 122 in the medium conveyance path, temperature sensors that detect temperatures of respective portions of the device, and the like.

When images are to be formed at both faces of the paper 122 (two-sided printing), a method as follows may be implemented: (1) a method of, after a first face of the paper 122 is printed, inverting the paper 122 front-to-back, passing the paper 122 through a similar inkjet recording device, and printing the second face of the paper 122; (2) a method of, after the first face of the paper 122 is printed, inverting the paper front-to-back with an unillustrated conveyor, returning the paper 122 to a stack position (the paper supply section 110 of the inkjet recording device 1 shown in FIG. 1), and printing the second face of the paper 122; (3) a method of, after the first face of the paper 122 is printed, a user inverting the paper 122 front-to-back and returning the paper 122 again to the stack position (the paper supply section 110 of the inkjet recording device 1 shown in FIG. 1), and printing the second face; and so forth. With method (3), a mode is preferable in which the user instructs, through an interface with a computer, whether the first face or the second face of the paper 122 should be printed.

—Details of Particle-Providing Step and Drying Step—

Figure 2:
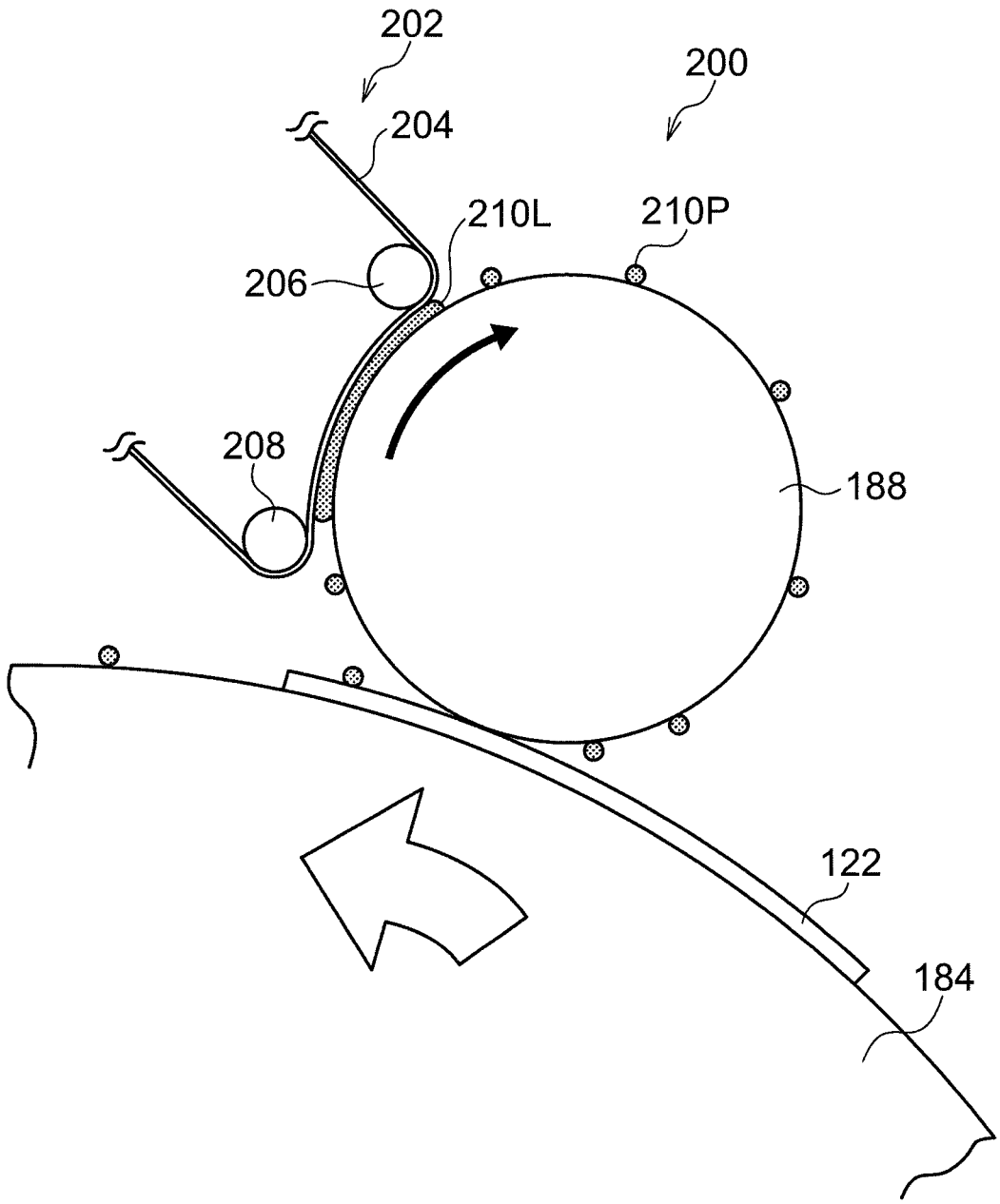
FIG. 2 is a structural diagram illustrating a particle provision device that is used in the image forming device illustrated in FIG. 1.

FIG. 2 shows details of the particle provision apparatus 200 at which the particle-providing step is implemented.

As described above, the particle provision apparatus 200 is provided with the fixing roller 188 (the heating and pressing roller) that serves as the example of the roller, and the supply unit 202 that is disposed at the fixing roller 188 rotation direction upstream side relative to the position at which the fixing roller 188 touches the paper 122. The supply unit 202 is provided with a belt-form web 204, a first rod 206 and a second rod 208. A particle dispersion, in which the numerous matting agent particles are dispersed in a liquid, is permeated through the web 204. The first rod 206 supports the web 204 from a rear face side such that the web 204 touches against the surface of the fixing roller 188. The rear face side of the web 204 is wound round the second rod 208 and the second rod 208 is for applying tension to the web 204.

The web 204 is supported by the first rod 206 from the rear face side and touches against the fixing roller 188, and tension is applied to the web 204 by the second rod 208 that does not touch against the fixing roller 188. The web 204 makes area contact over a breadth along the circumferential direction of the fixing roller 188. In a lateral direction of the paper contact area, the web 204 is arranged over substantially the whole length of the fixing roller 188.

Figure 3:
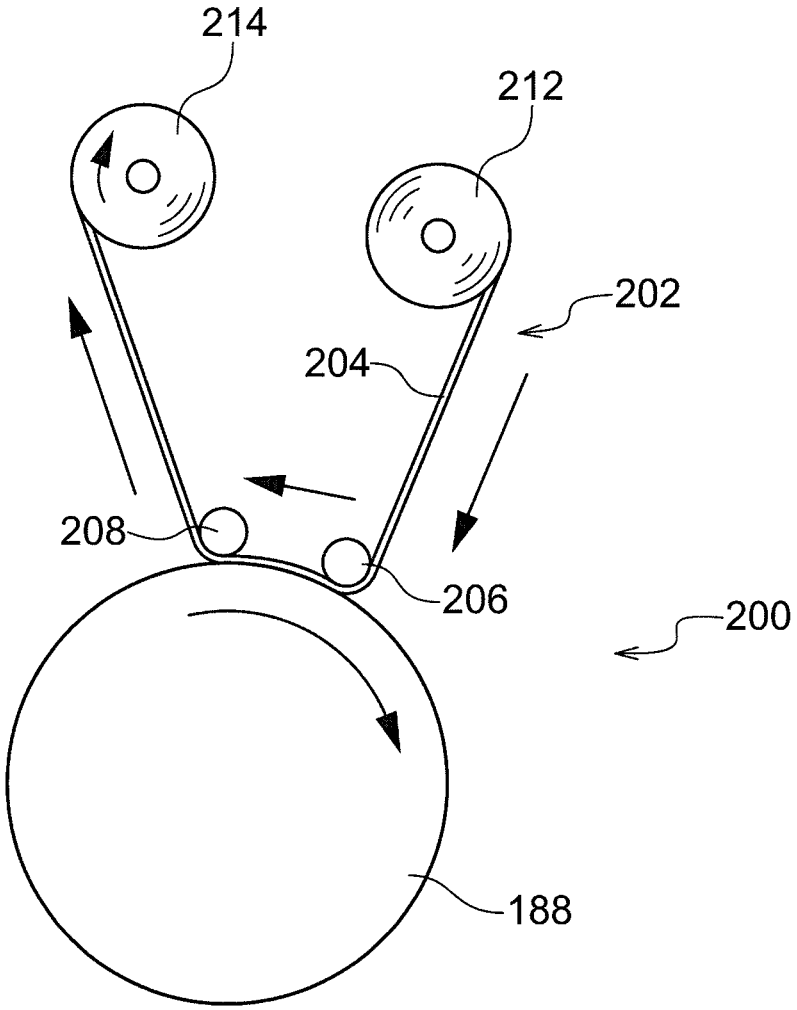
FIG. 3 is a diagram illustrating overall structure of the particle provision device that is used in the image forming device illustrated in FIG. 1.

The web 204 is constituted to move in a direction orthogonal to the lateral direction. For example, as illustrated in FIG. 3, the web 204 is provided with a feedout roller 212 and a winding roller 214. The feedout roller 212 is disposed at the web 204 movement direction upstream side relative to the first rod 206 and feeds out the web 204, and the winding roller 214 is disposed at the web 204 movement direction downstream side relative to the second rod 208 and takes up the web 204. Thus, at the position that touches against the fixing roller 188, the web 204 moves in the opposite direction (the direction of the arrows) from the rotation direction of the fixing roller 188. In the present exemplary embodiment, each time a predetermined number of sheets of paper have passed, the web 204 is moved by a predetermined amount in the direction of the arrows and renews the contact surface between the web 204 and the fixing roller 188.

Here, a bead is formed of a particle dispersion 210L between the web 204 and the fixing roller 188 at the fixing roller 188 rotation direction upstream side relative to the first rod 206. Thus, matting agent particles 210P may be reliably supplied to the fixing roller 188.

A cloth material or suchlike through which the liquid dispersion (the liquid in which the numerous matting agent particles are dispersed) may be permeated is used as the web 204. A nonwoven cloth or the like is used as a cloth material.

As the particles (the matting agent particles) used in the particle dispersion, for example, a plastic (for example, polymethyl methacrylate or polymethylene) or the like is preferable. As the liquid used in the particle dispersion, for example, a mold-releasing agent such as silicone oil or the like is preferable. It is preferable if diameters of the particles are 10 to 50 μm, more preferable if they are 10 to 30 μm, and even more preferable if they are 15 to 30 μm. If silicone oil is used as the liquid, when the liquid is applied to the recording face (image formation face) of the paper 122, glossiness of the image may be assured, in addition to which offsetting of the image on the fixing roller 188 may be suppressed.

Because the particle dispersion in which the numerous matting agent particles are dispersed is used, there is no activity of powdery particles (powder) in the inkjet recording device 1, in contrast with when powder particles are supplied directly to the fixing roller 188 and the recording face of the paper 122. Therefore, soiling of the interior of the inkjet recording device 1 is reduced.

If a dispersion medium such as an oil that serves as the particle dispersion is excessively provided to the recording face of the paper 122, uneven glossiness and/or uneven density (leading to repelling of the processing agent and/or the ink) becomes problematic. However, because the web 204 through which the particle dispersion is permeated is brought into contact with and supplies the particle dispersion to the fixing roller 188, the particle dispersion may be supplied to the fixing roller 188 in a state in which the particles are concentrated. Thus, dispersion medium amounts may be reduced compared to supply with another coating roller, a blade or the like. With a system in which the particle dispersion was directly coated, the liquid on the fixing roller 188 would be vulnerable to repelling and uniform coating would be difficult. However, because the web 204 through which the particle dispersion is permeated is brought into contact, dispersion medium amounts are reduced and, along with the effect of the particles being concentrated, the matting agent particles may be substantially uniformly coated on the fixing roller 188.

In this particle provision apparatus 200, by the web 204 through which the particle dispersion 210L, in which the matting agent particles are dispersed in the liquid, is permeated being touched against the fixing roller 188, the matting agent particles 210P are provided from the web 204 to the fixing roller 188 (a first transfer). Then, by rotation of the fixing roller 188, the matting agent particles 210P supplied to the fixing roller 188 are transferred and provided (a second transfer) to the recording face (image formation face) of the paper 122 on the fixing drum 184.

The matting agent particles 210P easily transfer from the fixing roller 188 at image portions of the paper 122 because of viscosity of an ink layer, but the matting agent particles 210P tend not to transfer from the fixing roller 188 at non-image portions of the paper 122. Therefore, the matting agent particles 210P are selectively provided to image portions of the paper 122.

It is preferable if the movement direction of the web 204 and the rotation direction of the fixing roller 188 are in opposite directions. Hence, an effect of the matting agent particles being wiped from the web 204 by the fixing roller 188 is provided. However, the movement direction of the web 204 and the rotation direction of the fixing roller 188 may be in the same direction.

Next, a drying step implemented by the drying section 116 and intermediate conveyance section 128 mentioned above is described.

Stacker blocking is frequent with paper 122 that has a coating layer. Therefore, the paper 122 is assumed here to be coated paper.

—Residual Water Amount—

Figure 4:
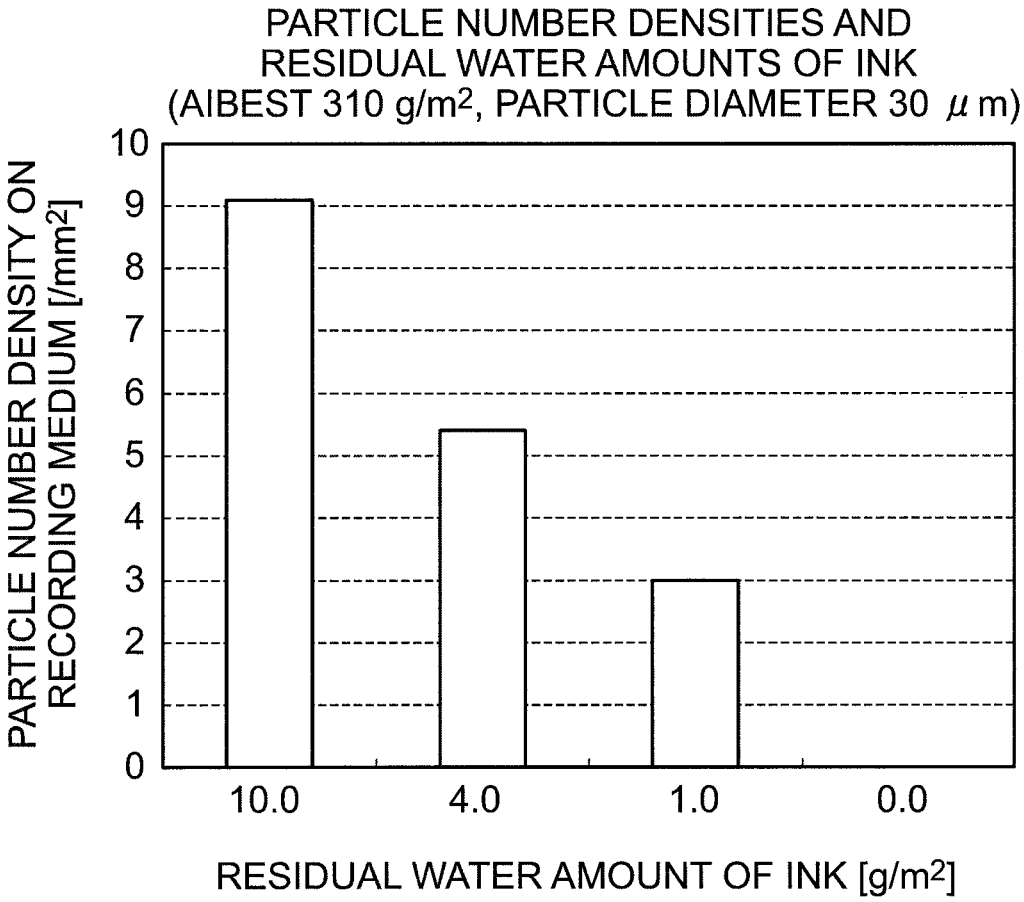
FIG. 4 is a graph illustrating a relationship between residual water amounts of ink when thick paper is used as paper and particle number densities on the paper.
Figure 5:
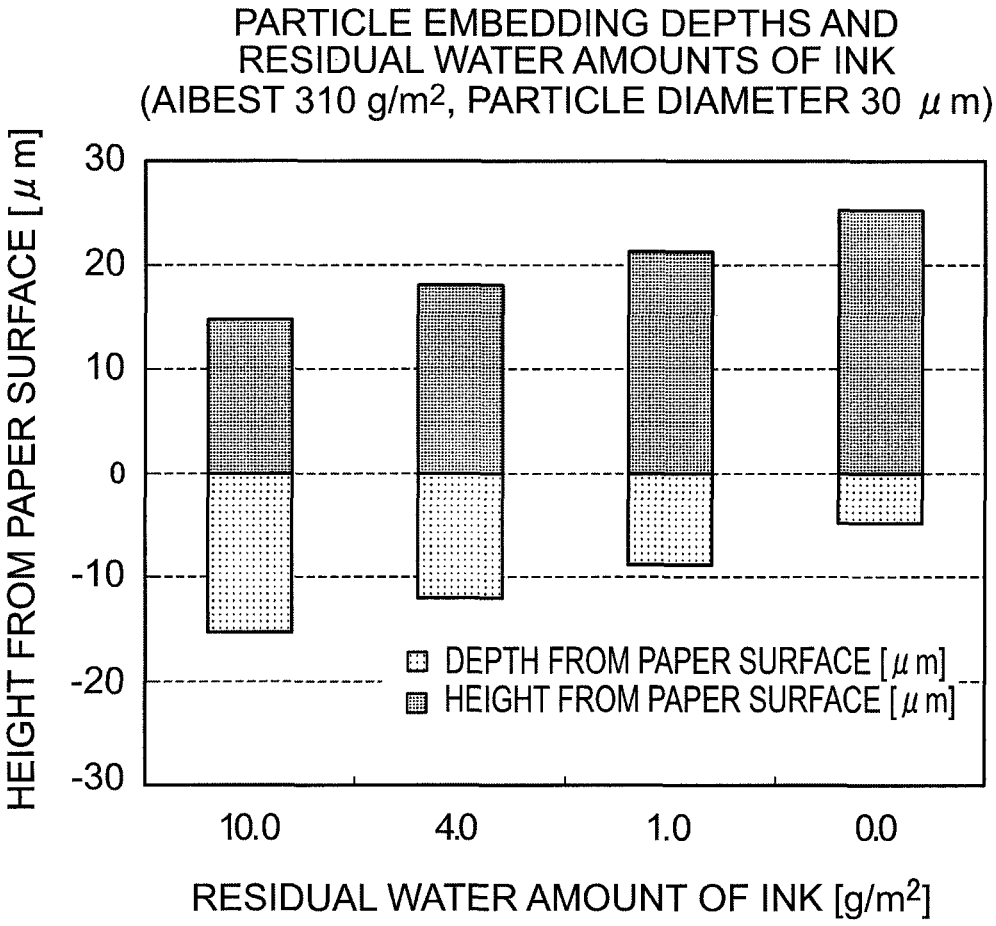
FIG. 5 is a graph illustrating a relationship between residual water amounts of ink when the thick paper is used as paper and particle embedding depths from the paper surface.
Figure 6:
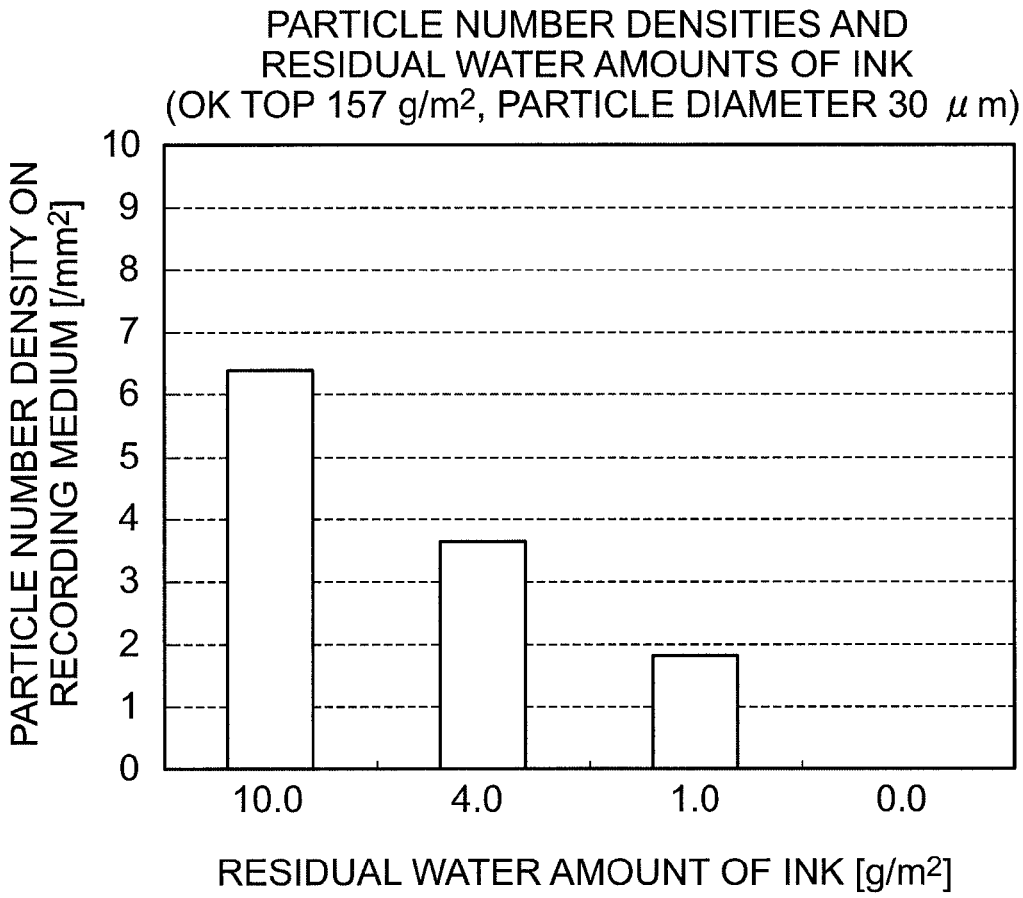
FIG. 6 is a graph illustrating a relationship between residual water amounts of ink when thin paper is used as paper and particle number densities on the paper.
Figure 7:
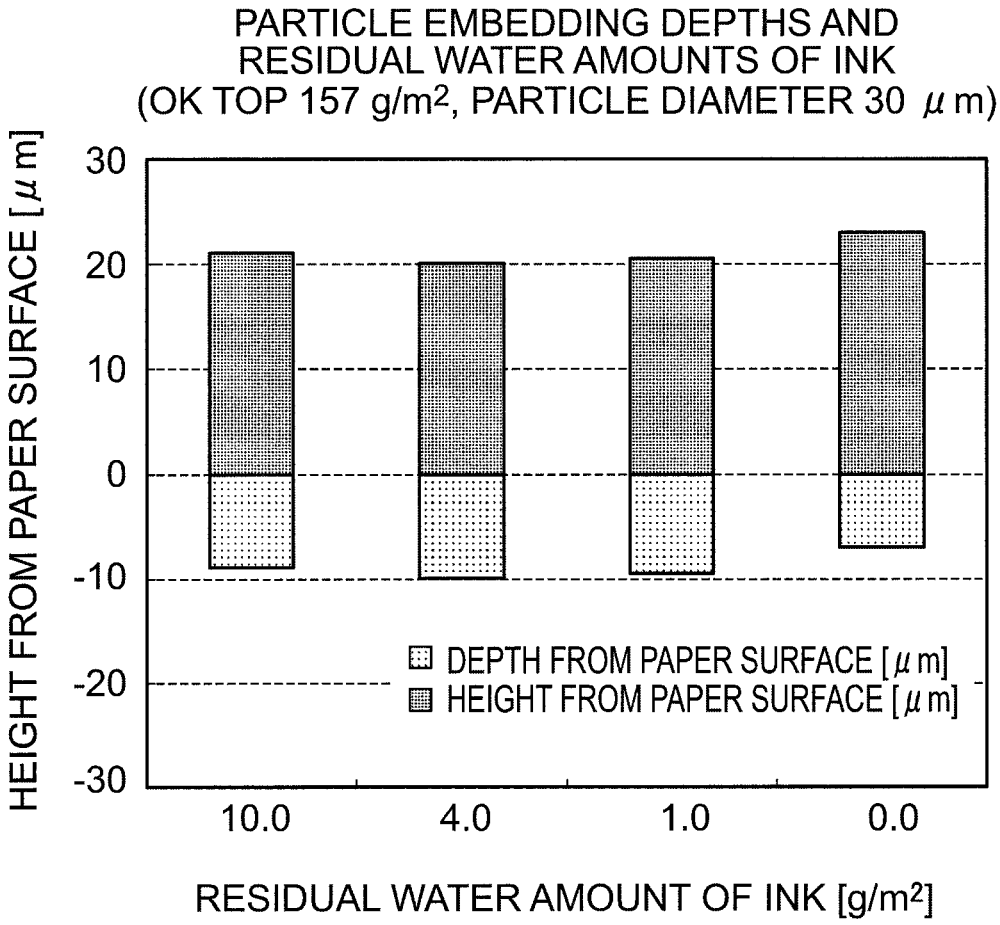
FIG. 7 is a graph illustrating a relationship between residual water amounts of ink when the thin paper is used as paper and particle embedding depths from the paper surface.

FIG. 4 to FIG. 7 present particle number densities on paper and embedding depths of the particles into the paper in relation to residual water amounts of ink after the drying step, when two kinds of paper are used (OK TOPCOAT, which is a thin paper with a weight of 157 gsm, and AIBEST, which is a thick paper at 310 gsm). FIG. 4 and FIG. 5 present the particle number densities on paper and embedding depths of the particles into the paper in relation to residual water amounts of inks when the thick paper is used (AIBEST, 310 gsm). FIG. 6 and FIG. 7 present the particle number densities on paper and embedding depths of the particles into the paper in relation to residual water amounts of inks when the thin paper is used (OK TOPCOAT, 157 gsm). Here, an aqueous ink is used as the ink ejected onto the paper 122. Residual water amounts of the ink on the paper 122 are values measured with a Karl Fischer moisture titrator. The meaning of the term "residual water amount of ink" as used herein includes a difference between a water amount that is contained in the paper 122 and a water amount that was initially contained in the paper 122.

As illustrated in FIG. 4 to FIG. 7, with either type of paper, thin paper or thick paper, the weaker the drying conditions (the greater the residual water amounts in the ink), the higher the particle number density of matting agent particles on the paper. Thus, it can be suggested that the greater a residual water amount in the ink at the paper 122 after the drying step, the softer the surface ink layer on the paper, and hence the easier it is for matting agent particles to adhere thereto.

Table 1 shows results of evaluations of stacker blocking in the testing described above. Evaluations are made by visual inspection of degrees of damage to image portions on papers in accordance with the following standard. With the thin paper (OK TOPCOAT, 157 gsm), the evaluation is "Good" if there is no stacker blocking in 1,000 sheets of two-sided printing, and the evaluation is "Bad" if stacker blocking occurs in 1,000 sheets of two-sided printing. With the thick paper (AIBEST, 310 gsm), the evaluation is "Good" if there is no stacker blocking in 200 sheets of two-sided printing, and the evaluation is "Bad" if stacker blocking occurs in 200 sheets of two-sided printing.

TABLE 1

<Stacker blocking evaluation results>

| | Residual water amount ($g/m^2$) | | |
|---|---|---|---|
| Paper type | 1.0 | 4.0 | 10.0 |
| OK TOPCOAT, 157 gsm | Good | Good | Bad |
| AIBEST, 310 gsm | Good | Good | Bad |

As illustrated in Table 1, the conditions in which the evaluation results for stacker blocking are "Good" are when the residual water amounts of the ink are from 1.0 to 4.0 $g/m^2$, for both kinds of paper. When the residual water amount of the ink is 10.0 $g/m^2$ (the undried condition), the particle number density is larger than with the other drying conditions, but the image swells because of water permeating into the coating layer of the paper. In consequence, it is easy for image portions to closely adhere with one another, and stacker blocking occurs.

Therefore, it is excellent if a residual water amount of ink realized after the drying step is at least 1.0 $g/m^2$, the lowest residual water amount of ink that can be achieved, and at most 4.0 $g/m^2$, a drying condition with which stacker blocking does not occur. In other words, it is preferable if the drying conditions of the drying step implement drying such that the residual water amount of ink (the difference between the water amount contained in the paper and the water amount initially contained in the paper) is from 1.0 $g/m^2$ to 4.0 $g/m^2$.

These drying conditions of the drying step are implemented by adjusting, for example, the heating temperature of the drying drum 176, the temperatures of the plural infrared heaters 178, the temperature and wind amount of the hot wind from the hot air heater 180, the temperatures and wind amounts of hot air from hot air heaters in the handover cylinder 130 of the intermediate conveyance section 128 and the like, and so forth.

—Minimum Film Formation Temperature MFT—

Figure 8:
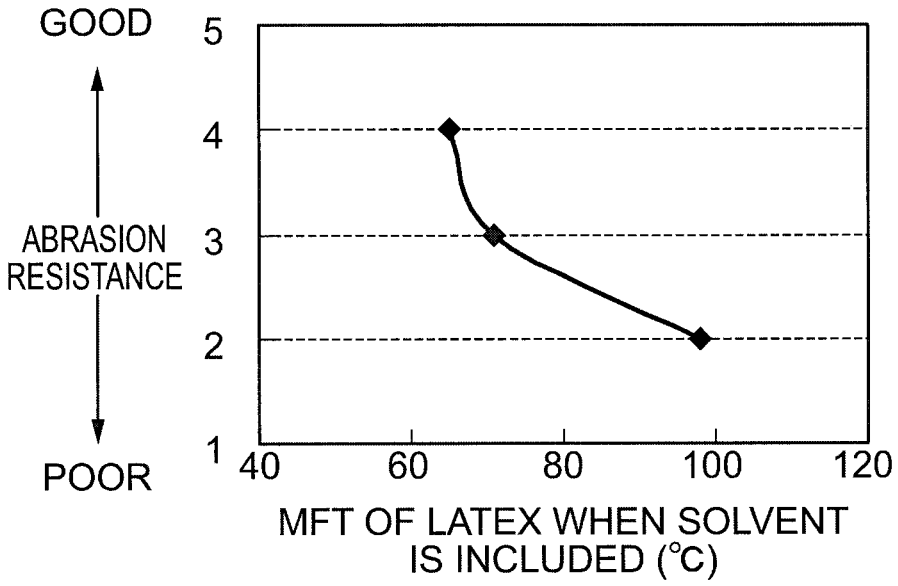
FIG. 8 is a graph illustrating a relationship between minimum film formation temperatures MFT of latex when a solvent is included and abrasion resistances.

FIG. 8 illustrates an evaluation result of abrasion resistance in relation to the minimum film formation temperatures MFT of latex (resin particles) when different kinds of solvent are included in the ink. As illustrated in FIG. 8, it can be suggested that, when the minimum film formation temperature MFT is higher, the abrasion resistance is poorer because film formation of the ink at the fixing section 118 is insufficient. Given the objective of providing greater numbers of matting agent particles, it can be suggested that it is better to deprecate film formation of the ink and thus improve close adhesion between image portions of the paper 122 and the matting agent particles. Accordingly, a temperature $T_s$ of the surface ink layer of the paper 122 after the drying step must satisfy the condition $T_s$<MFT. Furthermore, a surface temperature $T_r$ of the fixing roller 188 of the fixing section 118 must satisfy the condition $T_r$<MFT.

—Solvent Amounts Contained in Surface Ink Layer—

Figure 9:
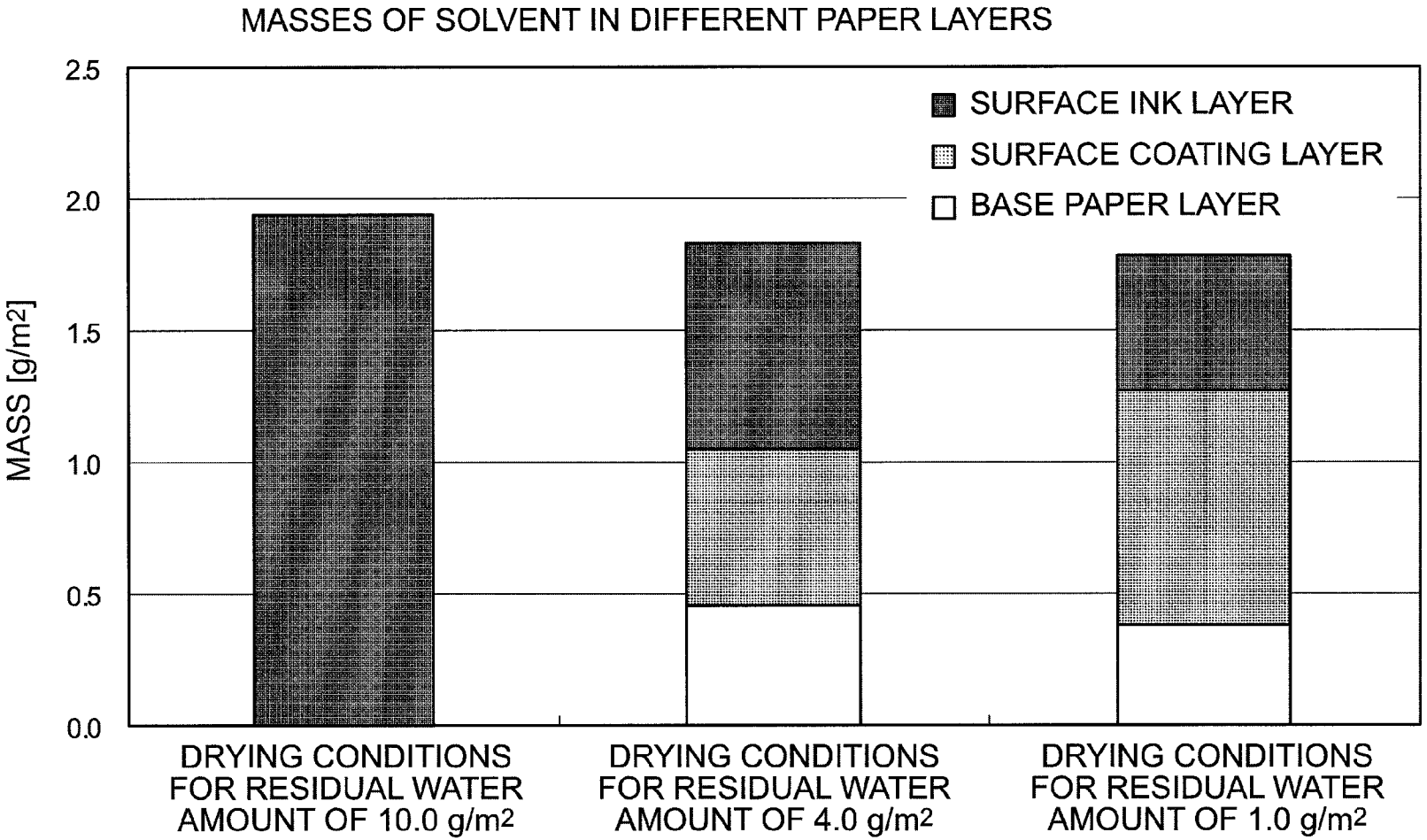
FIG. 9 is a graph illustrating a relationship between residual water amounts of ink and masses of aqueous solvent per unit area contained in a surface ink layer.

FIG. 9 illustrates masses of aqueous solvent per unit area in different paper layers in relation to the strength or weakness of drying conditions in the drying step. Here, masses of aqueous solvent per unit area in a surface ink layer of a paper, a surface coating layer and a base paper layer are shown. As illustrated in FIG. 9, given an aqueous solvent mass of 1.93 $g/m^2$ (100%) just after ink ejection onto the paper, a mass of aqueous solvent in the surface ink layer on the paper goes to 0.78 $g/m^2$ (40%) with weak drying conditions (corresponding to a water amount of 4.0 $g/m^2$), and goes to 0.51 $g/m^2$ (26%) with strong drying conditions (corresponding to a water amount of 1.0 $g/m^2$). In this range, the rate of stacker blocking is excellent (see Table 1).

Apart from the residual water amount in the surface ink layer on the paper 122 after the drying step, it can be suggested that when the amount of aqueous solvent is larger, matting agent particles adhere (adsorb) more easily because the surface ink layer on the paper is soft. Therefore, excellent matting agent particle transfer may be realized when a relationship between a mass per unit area $M_1$ of aqueous solvent contained in the surface ink layer on the paper just after ink ejection and a mass per unit area $M_2$ of aqueous solvent contained in the surface ink layer after the drying step satisfies the condition $0.25<M_2/M_1<0.50$. If $M_2/M_1$ is less than 0.25, the amount of aqueous solvent contained in the surface ink layer after the drying step is too small and it is difficult for the matting agent particles to adhere, and if $M_2/M_1$ is greater than 0.50, the amount of aqueous solvent contained in the surface ink layer after the drying step is large, and consequently image portions tend to closely adhere with one another and stacker blocking is likely to occur.

—Operation and Effects—

As illustrated in FIG. 1, the paper 122 supplied from the paper supply section 110 is conveyed along the outer periphery faces of the rotating paper supply cylinder 152 and the processing liquid drum 154. In the processing liquid application section 112, the processing liquid application apparatus 156 coats the processing liquid on the recording face (image formation face) of the paper 122 being conveyed along the outer periphery face of the processing liquid drum 154.

Via the intermediate conveyance section 124, the paper 122 on which the processing liquid has been coated is conveyed along the outer periphery face of the imaging drum 170. In the imaging section 114, the inkjet heads 172C, 172M, 172Y and 172K of the respective colors eject ink onto the recording face of the paper 122 being conveyed by the imaging drum 170 and form an image on the paper 122 (the ejecting step). Here, the ink comes into contact with the processing liquid that was previously applied to the recording face at the processing liquid application section 112, the colorants and resin particles dispersed in the ink coagulate, and coagulations are formed. Thus, flowing of colorants on the paper 122 or the like is prevented, and the image is formed on the recording face of the paper 122.

Via the intermediate conveyance section 126, the paper 122 on whose recording face the image has been formed is conveyed along the outer periphery face of the drying drum 176. In the drying section 116, water included in the paper 122 being conveyed by the drying drum 176 after the ink ejection is dried by heat from the infrared heaters 178 and the hot wind blown from the hot air heater 180, and water contained in the solvent that has been separated by the coagulation action is decreased (the first drying step).

Via the intermediate conveyance section 128, the paper 122 is conveyed along the outer periphery face of the fixing drum 184. In the intermediate conveyance section 128, water included in the paper 122 after the ink ejection is dried by a hot wind being blown from the hot air heater (not illustrated) at the recording face of the paper 122, and water contained in the solvent that has been separated by the coagulation action is decreased (the second drying step).

The residual water amount of the ink on the paper 122 (the difference between the water amount contained in the paper and the water amount that was initially contained in the paper) is brought to between 1.0 $g/m^2$ and 4.0 $g/m^2$ by the paper 122 passing through the drying section 116 and the intermediate conveyance section 128, reducing the water contained in the paper 122 after the ink ejection.

In the fixing section 118, the image that has been formed on the paper 122 is fixed to the paper 122 by pressing by the fixing drum 184 and the fixing roller 188.

The particle provision apparatus 200 is provided in the fixing section 118. As illustrated in FIG. 2 and FIG. 3, the web 204 is supported by the first rod 206 so as to touch against the fixing roller 188 and tension is applied to the web 204 by the second rod 208. In this state, the web 204 is moved in the direction of the arrows by being fed out by the feedout roller 212 and taken up by the winding roller 214.

In this particle provision apparatus 200, the matting agent particles 210P are provided from the web 204 to the fixing roller 188 (the first transfer) by the web 204 through which the particle dispersion 210L in which the matting agent particles are dispersed in a liquid has permeated being touched against the fixing roller 188. Then, by the rotation of the fixing roller 188, the matting agent particles 210P supplied to the fixing roller 188 are transferred and provided (the second transfer) to the recording face of the paper 122 on the fixing drum 184 (the particle-providing step).

While the matting agent particles 210P are easily transferred from the fixing roller 188 at image portions of the paper 122 due to the viscosity of the ink film, the matting agent particles 210P are less easily transferred from the fixing roller 188 at non-image portions of the paper 122. Therefore, the matting agent particles 210P are selectively provided to image portions of the paper 122. In FIG. 2, the matting agent particles 210P are provided to image portions of the paper 122 but the matting agent particles 210P are not matting agent particles formed only of powder particles, and the liquid also adheres.

As illustrated in FIG. 1, in the fixing section 118, the paper 122 retained at the fixing drum 184 passes through a region opposing the inline sensor 190, and a check pattern on the passing paper 122, a water amount, a surface temperature, glossiness and the like are measured.

The paper 122 that has been measured by the inline sensor 190 is conveyed by the handover cylinder 194 and the conveyance belt 196 and discharged to the discharge tray 192.

In this inkjet recording device 1, drying is carried out by the drying step such that the residual water amount of ink on the paper 122 (the difference between the water amount contained in the paper and the water amount that was initially contained in the paper) is from 1.0 $g/m^2$ to 4.0 $g/m^2$, and the matting agent particles are adhered to the recording face (image formation face) of the paper 122 retained at the fixing drum 184 by the particle-providing step. That is, because the difference between the water amount contained in the paper 122 after the drying step and the water amount initially contained in the paper 122 is made large, the surface ink layer on the paper 122 remains in a soft condition and a greater number of particles may be efficiently and reliably adhered to the recording face of the paper 122. Therefore, occurrences of stacker blocking when the paper 122 is stacked at a stacking section such as the discharge tray 192 or the like may be suppressed.

The drying step is carried out with the temperature lower than the minimum film formation temperature MFT, such that the relationship between the temperature $T_s$ of the surface ink layer on the paper 122 and the minimum film formation temperature MFT of the resin particles in the ink satisfies the relationship $T_s$<MFT, film formation of the ink is not complete and a greater number of matting agent particles may be adhered to the image portions of the paper 122 under conditions that are excellent for close adhesion of the matting agent particles with the image portions of the paper 122.

Furthermore, because the relationship between the temperature $T_r$ of the fixing roller 188 and the minimum film formation temperature MFT of the resin particles in the ink satisfies the relationship $T_r$<MFT (the image portions of the paper 122 are fixed by the fixing roller 188 at a temperature lower than the minimum film formation temperature MFT), film formation of the ink is not complete and a greater number of matting agent particles may be adhered to the image portions of the paper 122 under conditions that are excellent for close adhesion of the matting agent particles with the image portions of the paper 122.

The mass of aqueous solvent included in the surface ink layer on the paper 122 after the drying step is large such that the relationship between the mass per unit area $M_1$ of aqueous solvent contained in the surface ink layer on the paper 122 just after ink ejection and the mass per unit area $M_2$ of aqueous solvent contained in the surface ink layer after the drying step satisfies the condition $0.25<M_2/M_1<0.50$. Therefore, the surface ink layer on the paper 122 remains in a soft state and greater numbers of the matting agent particles may be adhered to the image portions of the paper 122.

In the particle provision apparatus 200, the matting agent particles are coated on the recording face of the paper 122 using the fixing roller 188 that is used in the inkjet recording device 1 previously. Therefore, the number of components may be kept down and fixing performance with respect to the paper 122 may be maintained.

—Other—

An exemplary embodiment of the present invention is described hereabove but the invention is not limited in any way by the above exemplary embodiment. It will be clear to those skilled in the art that numerous embodiments are possible within a technical scope not departing from the spirit of the present invention.

In the particle provision apparatus of the exemplary embodiment described above, the fixing roller 188 is used as an example of the roller, but this is not a limitation and a dedicated roller may be used. The feedout roller 212 feeding out the web 204 and winding roller 214 taking up the web 204 and suchlike are also not limited to the configuration of the exemplary embodiment described above and modifications thereof are possible.

An inkjet-type image forming device that employs aqueous inks using water as a solvent has been given as an example in the present exemplary embodiment. However, ejected liquids are not limited to inks for image formation, text printing or the like. The invention may be applied to various ejection liquids, provided they are liquids that use a solvent or dispersion medium that soaks into a recording medium.

What is claimed is:

1. An image forming method comprising:

ejecting aqueous ink onto a recording medium and forming an image;

after the ejecting, drying such that a difference between a water amount contained in the recording medium after the drying and a water amount contained in the recording medium before the ejecting is from 1.0 $g/m^2$ to 4.0 $g/m^2$; and after the drying, particle-providing including supplying particles to a surface of a roller and, via the roller, providing the particles to a face of the recording medium at which the image has been formed; wherein the ink comprises resin particles and an aqueous solvent, and, after the drying, a relationship between a temperature of $T_s$ of a surface ink layer to which the ink has been ejected onto the recording medium and a minimum film formation temperature MFT of the resin particles in the ink satisfies the condition $$Ts<MFT.$$

2. The image forming method according to claim 1, wherein the roller is a heating and pressing roller that fixes the image formed on the recording medium, the particle-providing includes supplying the particles to the surface of the heating and pressing roller, and pressing the heating and pressing roller against the recording medium, and a relationship between the minimum film formation temperature MFT and a temperature $T_r$ of the heating and pressing roller satisfies the condition $$T_r<MFT.$$

3. The image forming method according to claim 1, wherein a relationship between a mass per unit area $M_1$ of an aqueous solvent contained in a surface ink layer just after the ink is ejected onto the recording medium in the ejecting and a mass per unit area $M_2$ of the aqueous solvent contained in the surface ink layer after the drying satisfies the condition $$0.25<M_2/M_1<0.50.$$

4. An image forming device comprising:

an imaging section that ejects aqueous ink onto a recording medium and forms an image;

a drying section that dries the recording medium at which the image has been formed by the imaging section such that a difference between a water amount contained in the recording medium after the drying and a water amount contained in the recording medium before the ejecting is from 1.0 $g/m^2$ to 4.0 $g/m^2$; and a particle provision section that supplies particles to a surface of a roller and, via the roller, provides the particles to a face of the recording medium dried by the drying section at which face the image has been formed; wherein the ink comprises resin particles and an aqueous solvent, and a relationship between a temperature $T_s$ of a surface ink layer to which the ink has been ejected onto the recording medium dried by the drying section and a minimum film formation temperature MFT of the resin particles in the ink satisfies the condition $$Ts<MFT.$$

5. The image forming device according to claim 4, wherein the roller is a heating and pressing roller that fixes the image formed on the recording medium, the particle provision section supplies the particles to the surface of the heating and pressing roller, and presses the heating and pressing roller against the recording medium, and a relationship between the minimum film formation temperature MFT and a temperature $T_r$ of the heating and pressing roller satisfies the condition $$T_r<MFT.$$

6. The image forming device according to claim 4, wherein a relationship between a mass per unit area $M_1$ of an aqueous solvent contained in a surface ink layer just after the ink is ejected onto the recording medium at the imaging section and a mass per unit area $M_2$ of the aqueous solvent contained in the surface ink layer of the recording medium dried by the drying section satisfies the condition $$0.25<M_2/M_1<0.50.$$

* * * * *